US005910931A

United States Patent [19]

Pettyjohn

[11] Patent Number: 5,910,931

[45] Date of Patent: Jun. 8, 1999

[54] AUTOMOBILE INSPECTION REMINDER

[76] Inventor: Brad M. Pettyjohn, 2 Oriole Dr., Poughkeepsie, N.Y. 12601

[21] Appl. No.: 08/958,963

[22] Filed: Oct. 28, 1997

[51] Int. Cl.[6] ..... G04C 21/16

[52] U.S. Cl. ..... 368/251; 368/107; 368/108

[58] Field of Search ..... 368/107–113, 250–251

[56] References Cited

U.S. PATENT DOCUMENTS

| | | | |
|---|---|---|---|
| 2,932,779 | 4/1960 | Tancig | 368/108 |
| 5,124,957 | 6/1992 | Owens et al. | 368/107 |
| 5,243,579 | 9/1993 | Potthof | 368/107 |

*Primary Examiner*—Bernard Roskoski

*Attorney, Agent, or Firm*—Joseph B. Taphorn

[57] ABSTRACT

An automobile annual inspection reminder device sets off flashingly a bright light emitting diode (LED) approximately a month before the due date of the next automobile inspection. The device employs conventional battery operated digital watch circuitry to facilitate the setting of a counter/memory to the current time and date and the storage in memory of representations of the inspection due month and day thereof as well as of an earlier alarm date differing by a predetermined interval from the inspection-due date indicated by the facility and storing the same in the memory. A micro switch is provided for each of the twelve months of the year to set the inspection due date in memory. A "Snooze" button provides for temporary inactivation of the LED or beeper. After an inspection, the device can be set to the new inspection-due date.

3 Claims, 3 Drawing Sheets

AUTOMOBILE INSPECTION REMINDER

Applicant claims priority based on the filing of Invention Disclosure Document No. 410,845 on Jan. 13, 1997 in the United States Patent and Trademark Office.

1. Field of the Invention

This invention relates to reminder devices, and more particularly to a device for reminding the owner of an automobile that an inspection of the automobile is due on a particular date.

2. Background of the Invention

Various states have passed laws requiring an annual inspection of an automobile by an agency of the state to insure its continued road worthiness. Typically the next inspection date is set for the date a year away from the date of purchase of the automobile or the date of the instant inspection. Owners frequently overlook the inspection-due date and incur penalties for driving an automobile in an expired inspected condition.

3. Prior Art

Inspected automobiles usually are given a passed inspection certificate or sticker which manifests among other things the date, month, day, and year, in which the inspected condition expires, the certificate being color coded to reflect the inspection month. The certificate is mounted on the windshield of the automobile where the currency of the vehicle's inspected condition, as reflected by the certificate's color, may be readily observed by a highway police officer.

A reminder apparatus for another purpose is also known. Thus U.S. Pat. No. 5,025,426 issued Jun. 18, 1991 to Blumber and Olti, provides a key apparatus for reminding the user whether or not a lock was locked.

SUMMARY OF THE INVENTION

Accordingly, it is an object of the invention to provide a device for more effectively reminding an automobile owner that the day for inspection of his automobile to determine that it is in road-worthy condition, is arriving.

A further object of the invention is to provide an automobile owner with a reminder device that may be located so that its inspection-due signal will be readily observed by the owner.

A still further object of the invention is to provide a reminder device that is simple to use.

Another object of the invention is to provide a reminder device that is inexpensive to manufacture.

Still another object of the invention is to provide a reminder device which can be reused from year to year.

The objects of the invention are achieved through the provision of a device using circuitry similar to that found in a typical battery-powered digital watch. The device requires the user to set the present time and date and the expiration date of the inspection sticker. The device can be applied to the interior of an automobile, e.g. the dashboard, via a pressure-sensitive adhesive backing or a VELCRO mounting arrangement. A bright light-emitting diode (LED) on the device functions as an alarm: and may be made to flash, during the thirty days before upcoming inspection due date, to remind the owner of the inspection requirement.

The device is preprogrammed to activate the alarm a predetermined interval, e.g. 30 days, before the inspection due day. This gives the motor vehicle owner the luxury of making arrangements for dropping off the vehicle at an convenient time. Many inspection shops require holding the vehicle for many hours. Sometimes, even an appointment is necessary.

A feature of the invention is that the flashing LED can be temporarily turned off. The flashing LED can be temporarily turned off by pressing a twenty-four hour "snooze" button.

The flashing LED will also be turned off when a new inspection expiration date is set.

An advantage of the invention is that it uses commercially available technology that is inexpensive.

BRIEF DESCRIPTION OF THE DRAWINGS OF A PREFERRED EMBODIMENT

These and other objects, features and advantages of the invention will become apparent from a reading of the following description of a preferred embodiment of the invention when considered with the accompanying drawing wherein.

DETAILED DESCRIPTION OF THE PREFERRED EMBODIMENT

Figure 1:
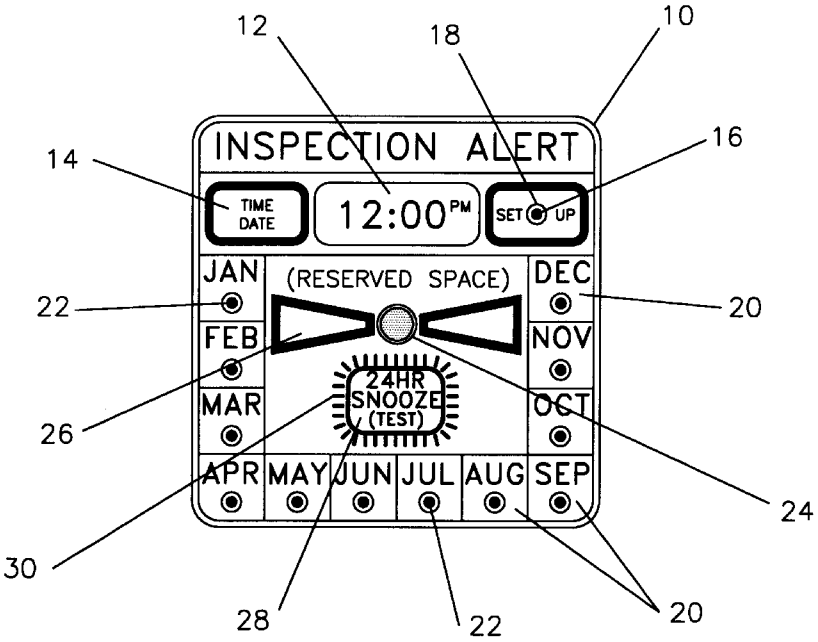
FIG. 1 is a front view of preferred embodiment of the device.
Figure 2:
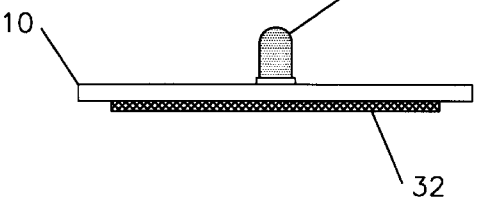
FIG. 2 is a top view of the device of FIG. 1, reversed from front to back.
Figure 3:
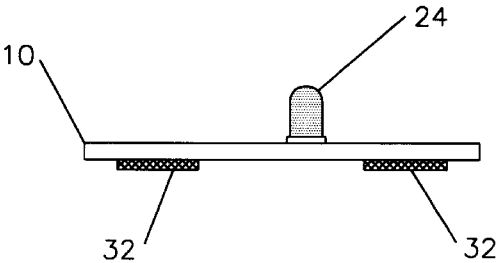
FIG. 3 is a side view of the device of FIG. 1, rolled ninety degrees to the right.

Referring now particularly to the device of FIGS. 1–3, a flat, thin, square-faced device generally indicated by the numeral 10, is shown as having the legend "INSPECTION ALERT" across the top of the front face of it. Below that, between two separated horizontal lines, is centrally located a conventional digital display 12, which may be liquid crystal, with hours being shown in the two digit spaces on the left and minutes in the two digit spaces on the right; the drawing indicating that the clock time is 12:00 PM. To the left of the display 12 is mounted a time- and date-setting large membrane or push button 14 that bears the legends "TIME" AND "DATE". To the right of the display 12 is mounted, within a generally rectangular encircled area that bears the legend "SET UP", a circular micro push button 16 that is used for setting-up purposes. The micro push button 16, formed with a central depression 18 so that it can easily be depressed with the tip of a ball point pen, is recessed so that it is not readily depressed otherwise.

Arranged about the perimeter of the face of the device below the two separated horizontal lines, are twelve small rectangular boxes 20. There is one box 20 for each month of the year. The boxes 20 may be said to be arranged in two side columns of four months each (JAN, FEB, MAR, and APR; AND SEP, OCT, NOV, and DEC), and one bottom row (MAY, JUN, JUL, and AUG). Thus the months are conveniently arranged in sequential order about the perimeter of the bottom portion of the face of the device.

Within each month box 20, there is a micro push button switch 22. Like the set up micro push button 16, the month micro push button switches 22 are each formed with a central depression so that they can easily be depressed with the tip of a ball point pen, and recessed so that they are not readily depressed otherwise.

The area on the face of the device below the bottom one of the two separated horizontal lines and within the side columns and bottom row of month boxes 20, is generally rectangularly shaped. In the upper center of the area is mounted an outwardly projecting light emitting diode (LED) 24 (FIGS. 1, 2, and 3). A beeper or buzzer (not shown) may be employed in lieu or in addition to the LED. Black (other colors may be substituted) arrow graphics 26 help the observering eye to focus on the LED.

Below the bright LED 24 is mounted a twenty four hour snooze and test membrane or push button switch 28 labeled "24 HR SNOOZE (TEST)" The button 28 is surrounded with outwardly radiating black (any color may be substituted) tic graphics 30 for directing attention to it.

As best seen in FIGS. 2 and 3, horizontal strips of pressure sensitive adhesive backing 32 may be used to facilitate easy mounting of the device on the windshield or dashboard of an automobile.

Figure 4:
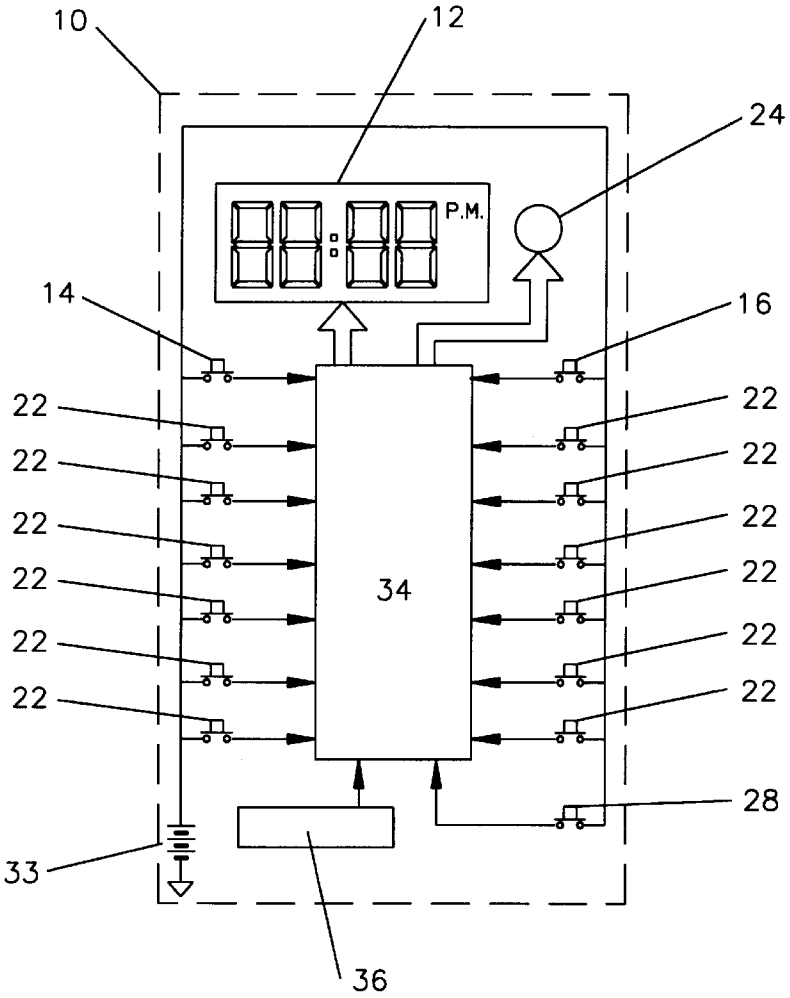
FIG. 4 illustrates the electrical construction of the device of FIG. 1.

The diagram of the overall electrical construction of the device is shown in FIG. 4. The liquid crystal display 12 is shown in the upper left of the diagram and the LED 24 in the upper right side. The time- and date-setting large membrane or push button switch 14 is above the left hand column of monthly switch boxes 20, and the set-up micro switch 16 is above right hand column of switch boxes 20. Below the membrane switch 14 on the left hand side and the micro switch 16 on the right hand side are the four micro switches 22 for the first four months and the last four months of a year respectively. As indicated in the diagram, closure of any of the switches 14, 16, and 22 causes the plus side of a battery 32 to be imputted to the central counter and memory 34 which also receives imput from and oscillator and outputs to the LCD display and LED, all in conventional fashion. Closure of the push button 28 for the 24 hour snooze or test button will also imput an appropriate signal into the counter and memory. A continously running oscillator 36 also imputs the counter and memory to provide timing signals utilized in standard fashion.

Figure 5:
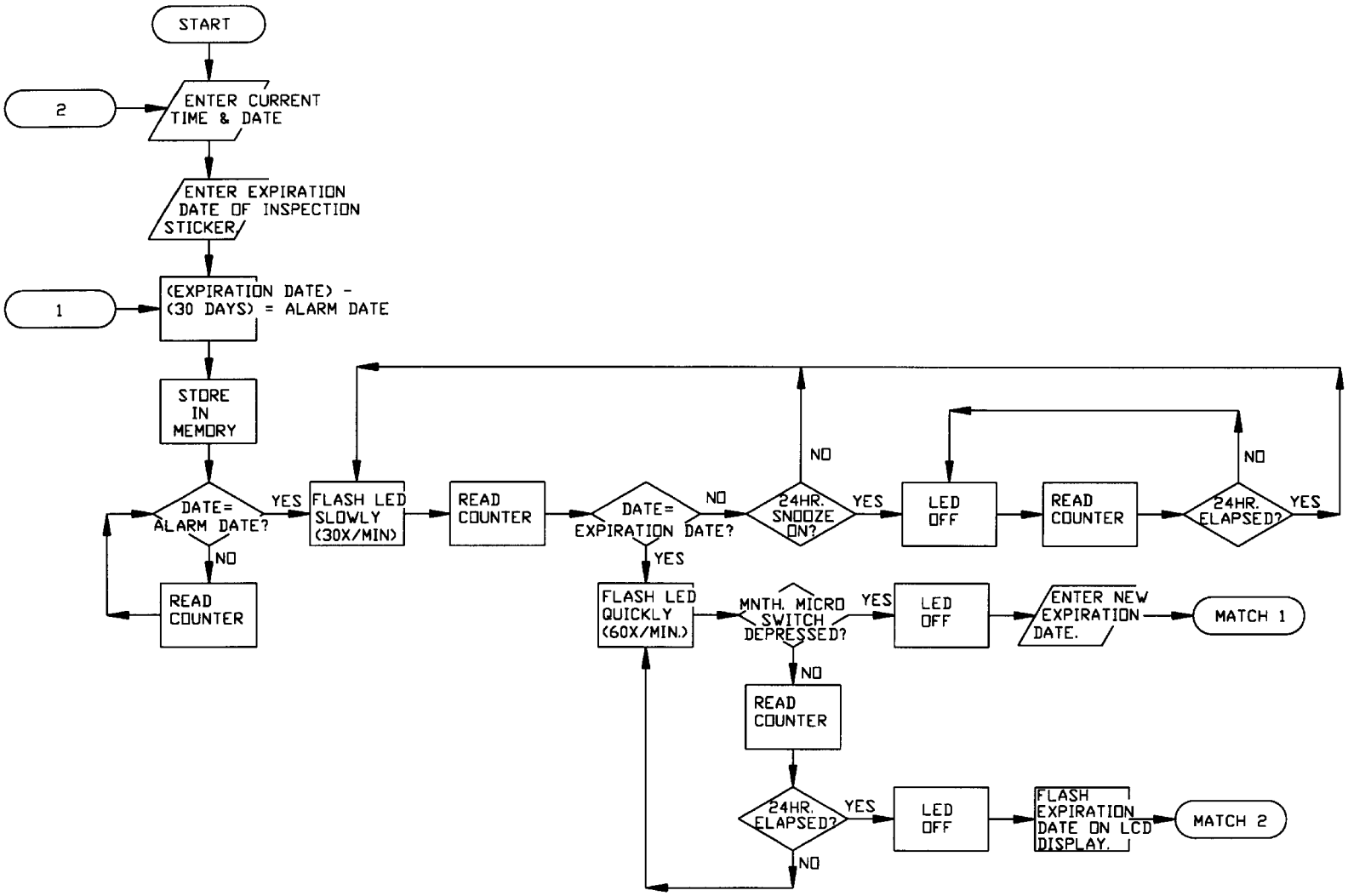
FIG. 5 is a block diagram illustrating the electrical circuit utilized with the device of FIGS. 1 and 4.

FIG. 5 shows the logic for using the instrumentalities of the device. After insuring that a battery 33 is in place in the device, the user of the device 10, who normally will be the owner of the automobile, would first push the the SETUP button 16, then the TIME membrane or button switch 14 to set the current time in the device which would appear on the LCD display 12.

When the correct time is displayed, the user would again push the micro push button 16 to record semi-permanently the displayed time in memory 34. Pushing of the date button 14 at this time will imput the current date into the counter/memory 34, which when reflected on the display can be semi-permanently stored in memory by again pushing the set-up micro switch 16.

Next the month that inspection is due is entered into the counter/memory 34. This is done by depressing the micro switch 22 for the appropriate month. The month depressed will now be indicated on the LCD display 12. If the wrong month was entered, the micro switch for the correct month is depressed.

The day digits are now flashing. To advance the day digits, the TIME/DATE pushbutton is held down until the correct day is shown. When the correct day is displayed, the set-up micro switch is again depressed to store semi-permanently the inspection due date in memory. This action will also automatically record in memory 34 a date 30 days earlier than the inspection date to give an alarm to the vehicle user. When the alarm date is reached, the alarm is given to alert the vehicle operator for up to 30 days.

In the event nothing further is done, the counter/memory 34 will when the alarm date is reached, activate the LED 24 to render it flashing. If the owner responds appropriately, he will have his car promptly inspected, and will reset the device following the steps outlined above. If he chooses to dawdle, he may push the snooze push button 28 to cut off flashing of the LED for one day. This action may be repeated as often as the owner finds suitable.

It may also occur to the owner to check that his device is set with the proper due date. This concern may occur as when he dropped the device or hasn't replaced the battery in several years. Thus when the push button 28 is depressed and the LED 24 is not flashing, it will cause the inspection date setting in memory to be indicated on the LCD display 12. If an incorrect inspection date is being displayed, the correct date is entered and the set up button 16 depressed to enter it into memory.

To insure that the alarm date obtains in memory, the TEST button 28 may be depressed again within thirty seconds of the inspection date test, to display the alarm date setting in memory.

Recapitulation

To Use

| Time and Date Set up: |
|---|
| With ball point pen or the like, press the recessed set up button 16. This will place the device in set up mode and the display 12 will now flash the hour digits. |
| Push down the time/date button 14 and hold to advance the hour digits. When the current hour is reached, the time/date button 14 is released and the set up button 16 depressed to enter the correct hour into memory 34, and display will now flash the minute digits. |
| Push down the time/date button 14 again and hold to advance the minute digits. When the current minute is reached, the time/date button 14 is released and the set up button 16 depressed to enter the current minute into memory 34, and the display will now flash the month digits (in the hours area). |
| Push down the time/date button 14 again and hold to advance the month digits. When the current month is reached, the date button is released and the set up button 16 depressed to enter the current month into memory 34. The display will now flash the day digits. |
| Push down the time/date button 14 again and hold to advance the day digits. When the current day is reached, the date button is released and the set up button 16 depressed to enter the current day into memory 34. The device will now return to regular (nonflashing) mode. |

Alarm set up is automatic, the device circuitry automatically records an alarm date 30 days prior to the inspection due date, and gives alarm on the alarm date.

To check

| |
|---|
| Time mode will normally be displayed. To switch to date mode, push down and hold the large time/date button 14; when it is released, the time display mode will automatically be displayed. If there is an error in the item displayed, repeat the set-up steps therefor with the correct information. |
| Depress set up button 16. First the hour stored in memory will be flashingly displayed. If it is not the current hour, the date key 14 is depressed to enter the current and further action taken. If it was the current hour, the set up key is depressed again to advance to the minute mode and proceed similarly. Similar action is taken for the month and day modes. |
| Inspection date setting. The user simply enters the month and day again. Or he can depress the test button 28 which will cause the recorded inspection date to appear on the display 12. |

Operating Functions

| Time/Date button: |
| --- |
| Advances the hour, minute, month and day if the set-up button was previously depressed to select that mode: |
| If the set up button 16 was not previously depressed, the display 12 indicates, when pressed, temporarily the date |
| 24 hour snooze/test button: |
| If alarm (LED) flashing, depression stops flashing for twenty four hours or until a new inspection expiration date is set. |
| If alarm is not flashing, depression causes the current setting of the inspection date to appear flashingly on the LC display 12 for as long as it is depressed. The LED 24 also will flash while this button is being held down. A depression again within 30 seconds of the first release will cause the alarm date to be displayed. |

If the battery is replaced, the set-up procedure is repeated.

It is evident that applicant has provided an automobile annual inspection reminder device 10 comprising an instrumentality (lamp 24) for indicating a warning that an inspection is due, a digital clock (counter 34 and oscillator 36) for keeping monthly time and representations thereof, a facility (micro switches 20 for indicating to the device which one of the different months of a year that an inspection is due in, and circuitry for activating the instrumentality for indicating a warning when the digital clock reaches an automatically calculated and stored in memory alarm date.

While a preferred embodiment of the invention has been set forth and described, it will be apparent to those skilled in the art that other and different embodiments may be made using the principles of the invention. It is therefore intended to be limited only by the spirit or scope of the appended claims.

What is claimed is:

1. An automobile annual-inspection reminder device comprising:

an instrumentality for indicating a warning that an inspection is due, a digital clock for keeping time, a facility for indicating to the device the date that an inspection is due, circuitry for activating the instrumentality for indicating a warning when the digital clock reaches a date prior to that indicated by the facility, wherein the facility includes separate apparatus for indicating every month of the year, and wherein the device is flat and the separate apparatuses are arranged about the perimeter of the device.

2. An automobile annual-inspection reminder device according to claim 1, wherein the separate apparatuses are arranged about the perimeter of the device in the chronological order of the corresponding months.

3. An automobile annual inspection reminder device comprising an instrumentality for indicating a warning that an inspection is due, a digital clock for keeping day and month time and representations thereof, a facility for indicating to the device which one of the different months of a year that an inspection is due in and the particular date, circuitry for calculating an earlier date differing from the inspection-due date indicated by the facility and storing the same in the memory, circuitry for periodically checking and activating the instrumentality for indicating a warning when the digital clock reaches the calculated date, wherein the facility includes an apparatus for each month and each apparatus is a push button switch, and the device is flat and the apparatuses are arranged about the perimeter of the device chronological order of the corresponding months, wherein the digital clock is provided with equipment for being set to the current month and day and for also being set to the current hour and for also being set to the current minute;

wherein the instrumentality for indicating a warning that an inspection is due is a beeper or a buzzer or a lamp that is a light emitting diode that is flashed when indicating a warning and that can be temporarily turned off; and a display on which the digital clock normally shows the current time to which it is set but that can be made to show the current date to which it is set instead or to show the date indicated to the device by the facility as the one in which the inspection is due or the calculated alarm date.

* * * * *